US008387711B2

(12) United States Patent
Cordell et al.

(10) Patent No.: US 8,387,711 B2
(45) Date of Patent: Mar. 5, 2013

(54) EXTENDED COVERAGE ORDINARY HAZARD HORIZONTAL DRY TYPE SPRINKLER AND SYSTEM

(75) Inventors: Robert Michael Cordell, Providence, RI (US); Manuel R. Silva, Jr., Cranston, RI (US)

(73) Assignee: Tyco Fire Products LP, Lansdale, PA (US)

( * ) Notice: Subject to any disclaimer, the term of this patent is extended or adjusted under 35 U.S.C. 154(b) by 311 days.

(21) Appl. No.: 12/105,480

(22) Filed: Apr. 18, 2008

(65) Prior Publication Data

US 2008/0257564 A1 Oct. 23, 2008

Related U.S. Application Data

(60) Provisional application No. 60/912,643, filed on Apr. 18, 2007.

(51) Int. Cl.
*A62C 37/08* (2006.01)
*A62C 35/00* (2006.01)
*B05B 1/26* (2006.01)

(52) U.S. Cl. ..... 169/17; 169/37; 169/16; 169/5; 239/498

(58) Field of Classification Search ..... 169/17, 169/37, 5, 16; 239/504, 498, 518, 524
See application file for complete search history.

(56) References Cited

U.S. PATENT DOCUMENTS 4,296,815 A * 10/1981 Mears ..... 169/37
5,609,211 A * 3/1997 Meyer et al. ..... 169/37
5,669,449 A * 9/1997 Polan et al. ..... 169/16
5,967,240 A * 10/1999 Ondracek ..... 169/38
6,374,919 B1 * 4/2002 Neill ..... 169/37
6,450,265 B1 * 9/2002 Ponte ..... 169/37
6,889,774 B2 5/2005 Multer et al.
7,516,800 B1 4/2009 Silva, Jr. et al.

OTHER PUBLICATIONS

Tyco Fire & Building Products, Data Sheet, Model SW-20 and SW24-11.2 K-factor Extended Coverage..(Standard Response), TFP230, Jan. 2005, 6 pages.
The Viking Corporation, Data Sheet, Quick Response Ordinary Hazard Dry HSW Sprinklers, Sprinkler 106i-106r, Apr. 13, 2007, 8 pages.
The Viking Corporation, Data Sheet, Standard Response Ordinary Hazard Dry HSW Sprinklers, Sprinkler 102j-102p, Apr. 13, 2007, 8 pages.
The Reliable Automatic Sprinkler Co., Inc., Model MBEC-14 (Sin R6932) Extended Coverage Ordinary & Extra Hazard . . . for Metal Building Applications, Bulletin 169, Rev. D., Oct. 2005, 6 pages.
National Fire Protection Association, Standard for the Installation of Sprinkler Systems, 2007 Edition, NFPA 13, Chapter 13, Section 13.2.2, pp. 13-123-13-125.

* cited by examiner

*Primary Examiner* — Len Tran
*Assistant Examiner* — Justin Jonaitis
(74) *Attorney, Agent, or Firm* — Perkins Coie LLP

(57) ABSTRACT

A dry sidewall sprinkler and system and methods of installation provide extended coverage for ordinary hazard commodities. The preferred sprinkler and systems provide for sidewall ordinary hazard fire protection beneath a sloped or horizontal overhang extending from a structure by at least ten feet proximate to a garage or loading dock in accordance with applicable sections of NFPA-13 (2007).

30 Claims, 10 Drawing Sheets

EXTENDED COVERAGE ORDINARY HAZARD HORIZONTAL DRY TYPE SPRINKLER AND SYSTEM

PRIORITY CLAIM & INCORPORATION BY REFERENCE

This application claims the benefit of priority to U.S. Provisional Patent Application No. 60/912,643, filed on Apr. 18, 2007 which is incorporated by reference in its entirety.

BACKGROUND OF THE INVENTION

The National Fire Protection Association (NFPA) promulgates standards relating to fire protection such as, for example, NFPA Standard 13 (2007) (hereinafter "NFPA-13 (2007)"), portions of which are incorporated in their entirety herein by reference thereto and attached hereto accordingly. For example Chapter 8, of NFPA-13 (2007), which is incorporated herein in its entirety is applicable to sidewall spray sprinklers. For example, Section 8.4.2 of NFPA-13 (2007) provides that sidewall sprinklers shall only be installed as follows: (i) light hazard occupancies with smooth, horizontal or sloped flat ceilings, and (2) ordinary hazard occupancies with smooth, flat ceilings where specifically listed for such use. Section 8.9 of NFPA-13 (2007) provides that for extended coverage sidewall sprinklers the maximum allowable protection coverage area for ordinary hazard is 400 square feet.

NFPA-13 (2007) specifically defines Ordinary Hazard Occupancies in Chapter 5 which is incorporated by reference in its entirety. Section 5.3.1 defines an Ordinary Hazard—Group 1 occupancies as being where combustibility is low, the quantity of combustibles is moderate, stockpiles of combustibles do not exceed eight feet and fires with moderate rates of heat release are expected. Section 5.3.2 defines an Ordinary Hazard—Group 2 occupancies as being where combustibility and quantity of combustibles is moderate to high, stockpiles of combustibles with moderate rates of heat release do not exceed twelve feet and stockpiles of combustibles with high rates of heat release do not exceed eight feet. Each of Sections 5.3.1 and 5.3.2 provide that dedicated and miscellaneous storage shall be protected in accordance with applicable sections of Chapters 12 and 13 of NFPA-13 (2007), each of which are incorporated by reference.

SUMMARY OF THE INVENTION

The preferred embodiments disclosed herein are believed to be the first dry sidewall sprinkler and dry sprinkler installations that provides extended coverage for ordinary hazard commodities. Moreover, the preferred systems and methods provide for sidewall ordinary hazard fire protection beneath a sloped or horizontal overhang extending from a structure by at least ten feet preferably proximate to a garage or loading dock in accordance with applicable sections of NFPA-13 (2007).

An advantage of the preferred sprinkler assembly and installation is that it permits the design of a sprinkler system that provides protection to an area that is subject to freezing temperatures by keeping the wet type portions of the system in a controlled environment and protected from freezing temperatures. In the preferred sprinkler system, the wet type portion of the sprinkler system is disposed in an environment that maintains a temperature above the freezing temperature of water. The dry type portion of the sprinkler system, including the preferred sprinkler assembly, extends from the wet type portion of the system through a barrier or wall and into an area that is subject to freezing temperatures. More preferably, the wet type system is disposed internal to a building having a controlled temperature and the dry type portion extends from the wet type and through a wall of the building into an area with an uncontrolled temperature or a temperature that is below the freezing temperature of water, such as into a freezer or out to an external environment to the building. Most preferably, the wet type portion is disposed internal to a building and the dry type portion extends through an exterior wall of the building to an area outside of the building, such as to an area adjacent to an external loading dock to the building.

Another advantage of the sprinkler assembly is that it permits a sprinkler system design that provides protection to an area that is subject to freezing temperatures without the need for a second dry type system. The sprinkler assembly connects directly to the wet type portion of the system without the need for a secondary dry type system in the area subject to the freezing temperatures.

Accordingly, a preferred embodiment of the present invention provides a horizontal sidewall, dry type sprinkler assembly and system. The preferred sprinkler includes a tubular casing having a proximal end and a distal end, the proximal end of the dry tube for connection to a wet system having a liquid supply. The casing defines a dry passageway along a longitudinal axis when the sprinkler is unactuated and further provides communication of liquid between the proximal and the distal end when the sprinkler is actuated. The preferred sprinkler further includes a sprinkler body coupled to the distal end of the tube. The body includes a frame and a pair of frame arms extending distal of the frame. The frame defines an outlet in communication with the passageway for discharge of the liquid. Distal of the outlet is a deflector coupled to the frame arms for distribution of the liquid discharged from the outlet. A sealing assembly is disposed within the passageway to control liquid flow from the supply to the frame outlet. The sealing assembly preferably includes a seat member disposed in the outlet having a proximal surface disposed within the passageway for engaging the liquid upon activation of the sprinkler. The proximal surface defining at least a portion oblique to the longitudinal axis and a portion transverse to the longitudinal axis. The preferred sprinkler further preferably provides extended coverage for ordinary hazard occupancies.

The preferred sprinkler has an actuated and an unactuated state controlled by a thermally responsive device. The thermally responsive device is preferably a thermally sensitive bulb that supports a preferred sealing assembly to control the discharge of fire fighting liquid from the sprinkler. In the unactuated state, the bulb is supported against the preferred seat member. In response to a fire of a sufficient heat release, the thermally sensitive bulb shatters to actuate the sprinkler. Accordingly, a preferred method is provided for operating an actuated dry sidewall sprinkler having a sprinkler body defining a sprinkler axis and including a frame defining an outlet and having a pair of distally extending frame arms that converge toward the axis to define a frame window. The sprinkler includes a seat member disposed in the outlet having a proximal surface and a distal surface, and the method preferably includes locating the seat member of the actuated sprinkler in the frame window, engaging the pair of frame arms with two points along the periphery of the distal surface of the seat member to define a pivot axis substantially perpendicular to the sprinkler axis, and rotating the seat member about the pivot axis with fluid discharge from the outlet to eject the seat member from the window.

Another preferred embodiment provides a fire protection system installation for fire protection of an ordinary hazard beneath a sloped ceiling adjacent a vertical back wall in which the ceiling has a slope defined by a maximum rise of four inches per one foot of run. The system preferably includes a liquid supply and at least one sidewall sprinkler installed along the backwall beneath the ceiling. The sprinkler preferably includes a tube having a proximal end and a distal end, the proximal end of the dry tube for connection to a liquid supply. The tube preferably defines a dry passageway along a longitudinal sprinkler axis when the sprinkler is unactuated and further provides communication of the liquid between the proximal and the distal end when the sprinkler is actuated.

A sprinkler body is coupled to the distal end of the tube. The body preferably includes a frame and a pair of frame arms extending distal of the frame. The frame defines an outlet in communication with the passageway for discharge of the liquid when the sprinkler is actuated. A deflector coupled to the frame arms and distally spaced from the outlet for distribution of the liquid discharged from the outlet, the deflector includes a canopy portion radially spaced from the sprinkler axis, the sprinkler being installed such that the canopy portion is substantially parallel to the sloped ceiling so as to define a space therebetween of about six to twelve inches (6 in.-12 in.). In the installation, the liquid is supplied to the inlet of the at least one sprinkler at a minimum pressure such that upon activation of the at least one sprinkler, a minimum flow rate of the liquid ranging from about 38 GPM to about 64 GPM and a length of throw of liquid deflected off the deflector of about 16 FT to about 20 FT are provided.

Another preferred embodiment provides a method of fire protection for an ordinary hazard occupancy having a ceiling and a backwall. The method includes mounting at least one sidewall sprinkler having an actuated and an unactuated state and a deflector in a horizontal orientation along the backwall of the occupancy such that deflect defines a deflector-to-ceiling spacing of about 6 in. to about 12 in. The preferred method includes coupling an inlet of the sprinkler to a liquid supply such that there is a dry passageway ranging in length from about 4 inches to about 48 inches between the inlet and the deflector when the sprinkler is unactuated and further providing fluid communication between the inlet and the deflector when the sprinkler is actuated. Even further the preferred method includes providing a coverage area ranging from about 256 square feet to about 320 square feet.

Another preferred embodiment of dry sidewall horizontal sprinkler is provided having an actuated and an actuated state. The sprinkler includes a tube having a proximal end and a distal end. The proximal end of the dry tube is for connection to a liquid supply, and the tube defines a dry passageway along a longitudinal sprinkler axis when the sprinkler is unactuated and provides communication of the liquid between the proximal and the distal ends when the sprinkler is actuated. A sprinkler body is coupled to the distal end of the tube. The body includes a frame and a pair of frame arms extending distal of the frame. The frame defines an outlet in communication with the passageway for discharge of the liquid when the sprinkler is actuated. A deflector is coupled to the frame arms and distally spaced from the outlet for distribution of the liquid discharged from the outlet. The deflector includes a canopy portion radially spaced from the sprinkler axis. The deflector providing an extended coverage protection area at a density of 0.15 GPM per square foot to 0.20 GPM per square foot for an ordinary hazard occupancy.

BRIEF DESCRIPTIONS OF THE DRAWINGS

The accompanying drawings, which are incorporated herein and constitute part of this specification, illustrate exemplary embodiments of the invention, and, together with the general description given above and the detailed description given below, serve to explain the features of the invention.

DETAILED DESCRIPTION

Figure 1:
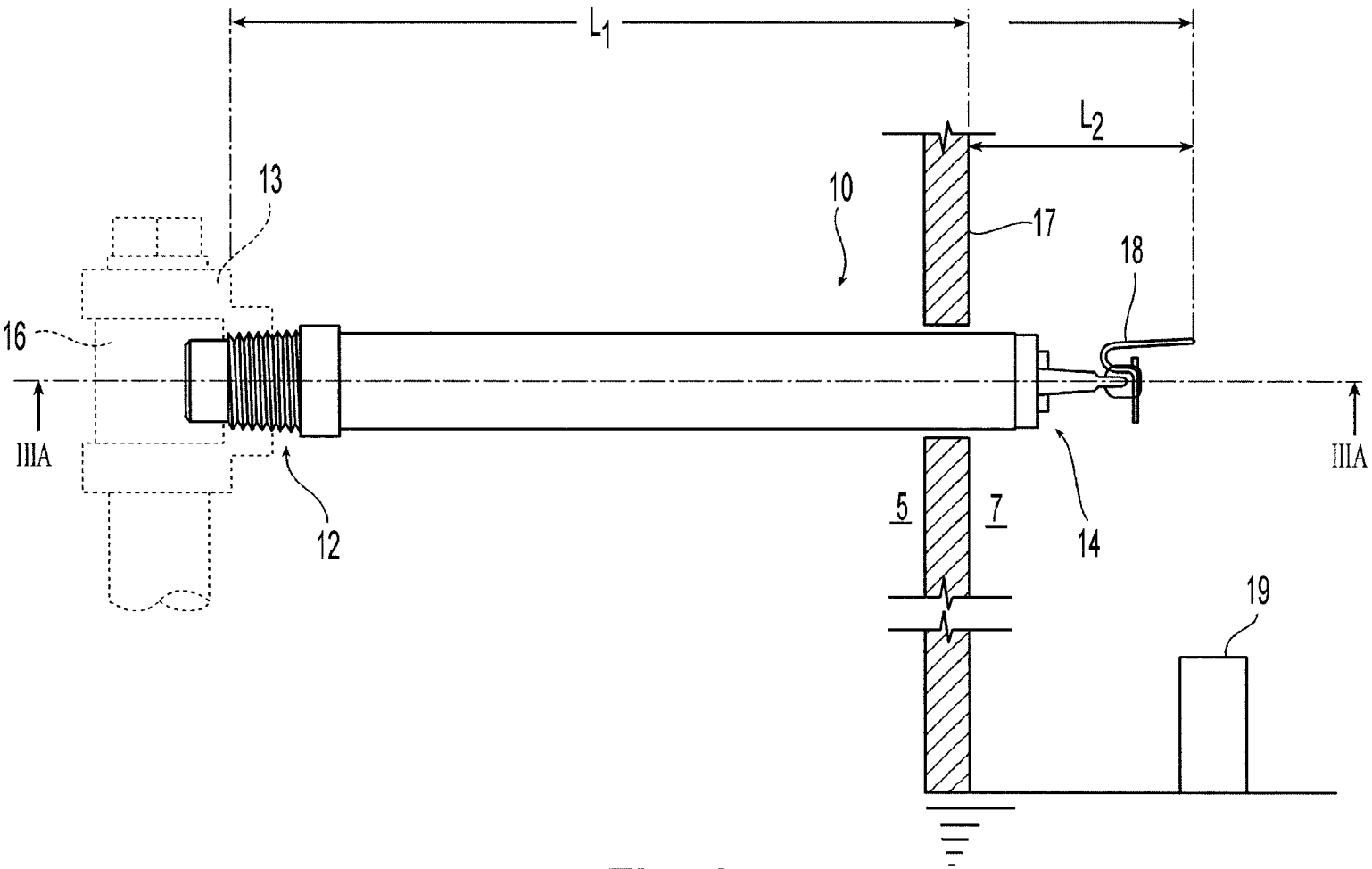
FIG. 1 is a schematic illustration of a preferred installation of a sidewall sprinkler.

Shown in FIG. 1 is a schematic illustration of a preferred sprinkler installation for providing fire protection to an occupancy. More specifically, shown is a preferred sidewall sprinkler 10 installed such that its sprinkler axis IIIA-IIIA is oblique to and more preferably horizontally over an occupancy which the sprinkler 10 protects. The preferred sprinkler installation preferably provides extended coverage ordinary hazard (ECOH) fire protection from a horizontal sidewall sprinkler. In particular, the sprinkler 10 is preferably for use in ordinary hazard occupancies with non-combustible unobstructed construction and with a ceiling slope not exceeding two inches of rise per one foot of run. Moreover, the preferred sprinkler 10 and its installation provides fire protection to an area that is subject to freezing temperatures by providing a dry sprinkler assembly sufficient to protect the wet or liquid supply piping to which it is coupled from freezing.

Generally the sprinkler 10 has a dry sprinkler assembly that includes an inlet at its proximal end 12 and an outlet at its distal end 14. In the installation of the sprinkler 10, the inlet is coupled to a liquid or wet fire fighting source such as, for example, a water supply or branch pipe 16. The proximal end 12 of the sprinkler 10 is preferably threadedly engaged with a fitting 13 of the wet supply pipe 16 located in an above-freezing environment 5. In particular, the proximal end 12 can include 1 inch to 1½ inch (1½ in.) NPT or other pipe thread and more preferably one inch NPT (1 in. NPT). The distal end 14 of the sprinkler 10 extends from or is mounted to a mounting surface or backwall 17 at a distance $L_2$ such that the outlet is located within and/or above the occupancy 7 being protected which may be subject to freezing conditions. The preferred sprinkler 10 and its dry assembly prevent liquid from standing stagnant in the distal end 14 of the sprinkler 10 thereby avoiding freezing of the liquid supply in either the sprinkler 10 or the water supply 16 by conduction.

More specifically, the sprinkler 10 axially spaces the distal end 14 from the proximal end 12 to define an axial distance therebetween to minimize the conduction of heat from the proximal end to the distal end to prevent freezing of the liquid supply. Moreover, the sprinkler 10 has two states: (i) an unactuated state and (ii) an actuated state that controls fluid communication or flow of the liquid between the inlet and the outlet of the sprinkler 10. The sprinkler 10 is preferably configured with a sealing assembly that in the unactuated state prevents liquid from entering the inlet of the sprinkler 10 and in the actuated state allows for the liquid to enter the inlet and flow to the outlet for discharge from the sprinkler 10. Accordingly, the combination of the spacing between the proximal and distal ends 12, 14 with the fluid control at the inlet facilitates the use of the sprinkler 10 in occupancies subject to freezing conditions with a direct inlet connection to a liquid or wet piping supply.

The preferred sprinkler 10 further includes a deflector 18 at its distal end. When the sprinkler is in its actuated state and appropriately installed in accordance with applicable sections of NFPA-13 (2007) such that the deflector is located at a distance H, six to twelve inches below the ceiling (6 in.-12 in.), liquid enters the inlet of the sprinkler 10 is discharged from the outlet and impacts the deflector 18 and is distributed over the protection area at a sufficient density for a preferred coverage area to effectively address a fire in the occupancy 7. Where the sprinkler is installed as a sidewall sprinkler for miscellaneous storage, the sprinkler is preferably installed so as to define a clearance space of at least thirty-six inches between the top of the deflector 18 and any miscellaneous storage 19. The sprinkler 10 and its deflector 18 are configured to define preferably extended coverage areas for ordinary hazard occupancy installations. Accordingly, the preferred sprinkler 10 and its installation provide a coverage area greater than the standard one hundred square feet of coverage area. Preferably, the sprinkler 10 and its installation provide protection for coverage areas ranging from about 256 square feet up to about 320 square feet. More preferably, the coverage area provided by the preferred sprinkler 10 and its installation are 256 square feet, 288 square feet and 320 square feet.

The coverage areas of the sprinkler 10 is defined by the distance at which the deflector 18 can distribute the liquid discharged from the outlet of the sprinkler 10. Preferably, the deflector 18 can distribute water from the outlet in the axial direction of the sprinkler so as to define a throw length of the sprinkler 10 of up to about twenty feet (20 ft.), and further radially distribute the discharged water over a span of about sixteen feet measured at the backwall laterally about the sprinkler axis. Accordingly, for a 256 square foot coverage area, the sprinkler 10 defines a span of about sixteen feet and a throw length of about sixteen feet (16 ft×16 ft); for a 288 square foot coverage area, the sprinkler 10 defines a span of about sixteen feet and a throw length of about eighteen feet (16 ft×18 ft); and for a 320 square foot coverage area, the sprinkler 10 defines a span of about sixteen feet and a throw length of about twenty feet (16 ft×20 ft).

The preferred coverage areas can further define a minimum lateral spacing between similarly configured sidewall sprinklers 10 located along a common backwall. Preferably, the sprinkler 10 and its coverage area preferably define a minimum lateral spacing from sprinkler axis-to-sprinkler axis of about eight feet.

The performance of the sprinkler 10 is further preferably defined by the flow rate of the water discharged from the sprinkler 10. More specifically, a preferred flow rate ensures that the sprinkler 10 provides a sufficient water distribution density to a given preferred coverage area in accordance with any applicable fire protection standard, such as, for example, Section 13.2.2 of NFPA 13 (2007). According to the Section 13.2.2., in the protection of Ordinary Hazard Group 1 storage, each of the coverage areas for the preferred sprinkler 10 require a water distribution density of about 0.15 gallons per minute per square foot (0.15 GPM/SQ. FT). Section 13.2.2. of NFPA-13 (2007) provides that in the protection of Ordinary Hazard Group 2 storage, each of the coverage areas for the preferred sprinkler 10 require a water distribution density of about 0.20 gallons per minute per square foot (0.20 GPM/SQ. FT).

Accordingly, in order for the sprinkler 10 to satisfy the distribution density of 0.15 GPM/SQ. FT. for Ordinary Hazard Group 1 storage, the sprinkler 10 and its installation are preferably configured to provide water discharge from the outlet at a minimum flow rate ranging from about thirty-eight gallons per minute (38 GPM) to about forty-eight gallons per minute (48 GPM). More specifically, where the sprinkler 10 is installed for Ordinary Hazard Group 1 storage having a coverage area of 256 square feet, the sprinkler 10 is configured to discharge water from the outlet at a minimum flow rate of about 38 GPM. Where the sprinkler 10 is installed for Ordinary Hazard Group 1 storage having a coverage area of 288 square feet, the sprinkler 10 is configured to discharge water from the outlet at a minimum flow rate of about 43 GPM. Where the sprinkler 10 is installed for Ordinary Hazard Group 1 storage having a coverage area of 320 square feet, the sprinkler 10 is configured to discharge water from the outlet at a minimum flow rate of about 48 GPM.

In order for the sprinkler 10 to satisfy the distribution density of 0.20 GPM/SQ. FT. for Ordinary Hazard Group 2 storage, the sprinkler 10 and its installation are preferably configured to provide water discharge from the outlet at a minimum flow rate ranging from about fifty-one gallons per minute (51 GPM) to about sixty-four gallons per minute (64 GPM). More specifically, where the sprinkler 10 is installed for Ordinary Hazard Group 2 storage having a coverage area of 256 square feet, the sprinkler 10 is configured to discharge water from the outlet at a minimum flow rate of about 51 GPM. Where the sprinkler 10 is installed for Ordinary Hazard Group 2 storage having a coverage area of 288 square feet, the sprinkler 10 is configured to discharge water from the outlet at a minimum flow rate of about 58 GPM. Where the sprinkler 10 is installed for Ordinary Hazard Group 2 storage having a coverage area of 320 square feet, the sprinkler 10 is configured to discharge water from the outlet at a minimum flow rate of about 64 GPM.

Providing the sprinkler 10 with the requisite discharge flow rate is preferably a function of the sprinkler structure and the pressure of the liquid supplied to the sprinkler. More specifically, the sprinkler 10 defines a preferred discharge coefficient or K-factor K of greater than 5.8 GPM/$(PSI)^{1/2}$, such as for example about 8 GPM/$(PSI)^{1/2}$, more preferably ranging from about 10.2 GPM/$(psi)^{1/2}$ to about 11.2 GPM/$(psi)^{1/2}$ and is even more preferably about 11.2 GPM/$(PSI)^{1/2}$. The flow rate Q from a sprinkler is substantially a function of the discharge coefficient and the supply pressure P as defined by the formula: $Q=K*(P)^{1/2}$.

Accordingly, for the sprinkler 10 with a preferred nominal K-factor of 11.2 GPM/$(PSI)^{1/2}$, the following minimum pressures indicated blow in Table 1 provide for the corresponding preferred minimum flow rates to the preferred sprinkler coverage areas so as to satisfy the distribution density requirements of NFPA 13 (2007).

TABLE 1

| Coverage Area (Square Feet) | Discharge Density Requirement (GPM/SQ. FT) | Minimum Flow Rate (GPM) | Minimum Pressure (PSI) |
|---|---|---|---|
| 256 | 0.15 | 38 | 11.5 |
| 256 | 0.20 | 51 | 20.7 |
| 288 | 0.15 | 43 | 14.7 |
| 288 | 0.20 | 58 | 26.8 |

TABLE 1-continued

| Coverage Area (Square Feet) | Discharge Density Requirement (GPM/SQ. FT) | Minimum Flow Rate (GPM) | Minimum Pressure (PSI) |
|---|---|---|---|
| 320 | 0.15 | 48 | 18.4 |
| 320 | 0.20 | 64 | 32.7 |

Figure 2:
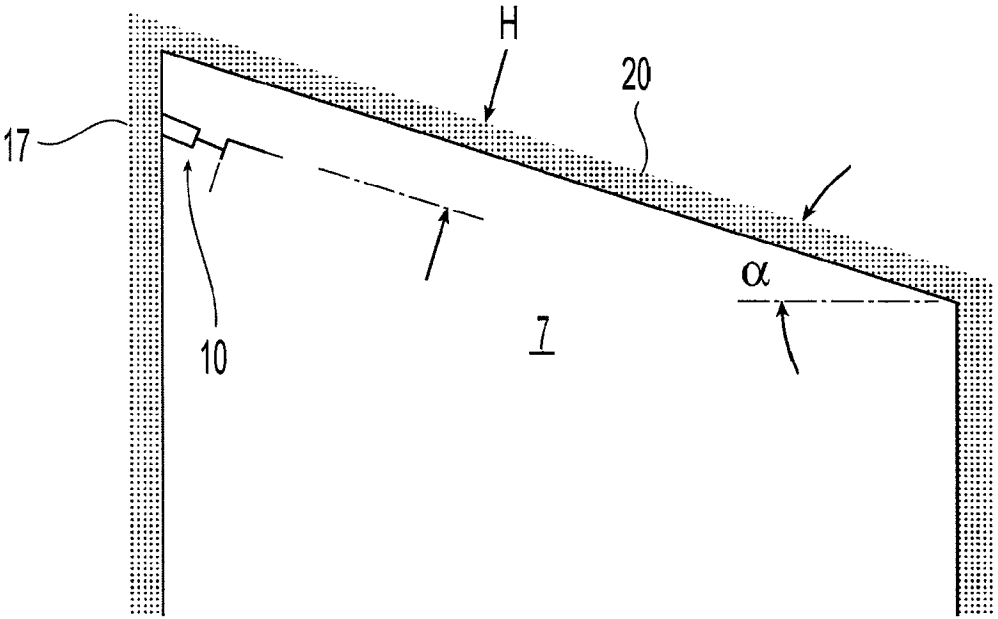
FIG. 2 is a schematic illustration of a another preferred installation.

The sprinkler 10 can further be used in another preferred installation. Shown schematically in FIG. 2 is the sprinkler 10 installed along a backwall 17 beneath a sloped ceiling 20 having a maximum roof slope a defined by a four inch rise per one foot run or about an eighteen degree (18°) slope. Such an occupancy configuration is used, for example, in loading docks. The sprinkler 10 is coupled to a wet water supply pipe (not shown) in a manner as described above and installed in accordance with installation requirements of Section 8.9 of NFPA-13 (2007). The sprinkler 10 can further be installed using the deflector-to-ceiling distances H and minimum water pressure parameters described above to provide for fire protection with the coverage areas and distribution densities described above. Accordingly, the preferred sprinkler 10 with its dry assembly can provide fire protection to the loading areas with sloped ceilings or overhangs that are subject to freezing temperatures.

Figure 3A:
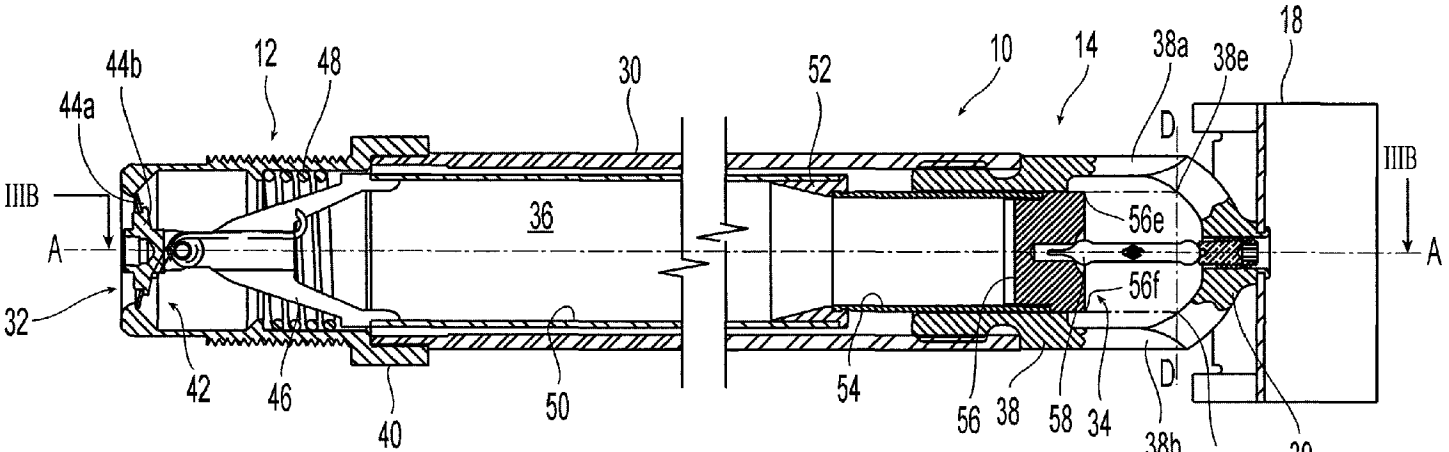
FIG. 3A is a cross-sectional view of the sidewall sprinkler of FIG. 1 along line IIIA-IIIA.

Shown in FIG. 3A is a cross-sectional view of the sprinkler 10, the dry sprinkler assembly preferably includes a tubular outer casing 30 extending along the sprinkler axis A-A having the proximal end 12 for locating the inlet 32 and the distal end 14 for locating the outlet 34. The casing 30 is substantially a substantially tubular member defining the passageway 36 for conveying the liquid between the inlet 32 and the outlet 34 of the sprinkler 10.

Preferably disposed about the proximal end 12 of the casing 30 is an inlet member 40 to further define the inlet 32. The inlet member 32 is substantially cylindrical member preferably having an internal thread end at its distal end for threaded engagement about the proximal end 12 of the casing 30. The outer surface of the inlet member 40 is also preferably threaded for threaded engagement with the fitting 13 of the supply pipe 16. The proximal end of the inlet member 40 has an opening centrally aligned along the sprinkler axis A-A to define fluid communication between the liquid supply 16, the passageway 36 and the outlet 34.

Disposed and secured at the distal end 14 of the casing 30 is a sprinkler body or frame 38. At its proximal end, the sprinkler frame 38 is preferably externally threaded for threaded engagement with an internal distal portion of the casing 30. The outer surface further preferably radially broadens toward its distal end to define a shoulder for engagement with the distal edge of the casing 30. The frame 38 has an inlet at its proximal end in fluid communication with the fluid passageway 36 and an opening at its distal end to define the outlet 34 of the sprinkler 10 from which water/liquid discharges to impact the deflector 18.

Figure 4B:
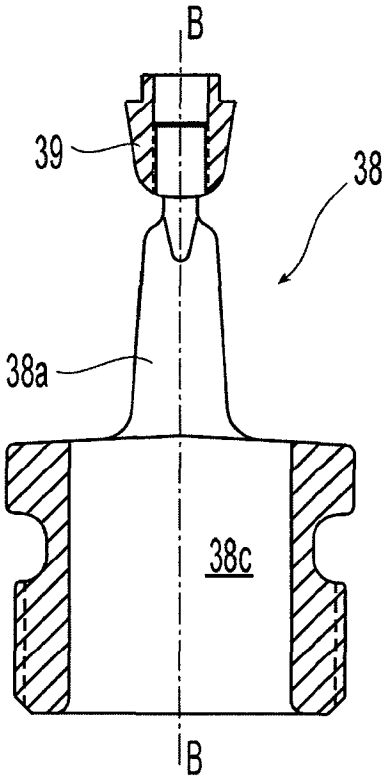
FIGS. 4A-4C are elevation, cross-sectional and plan views of a sprinkler frame for use in the sprinkler of FIG. 1.
Figure 4A:
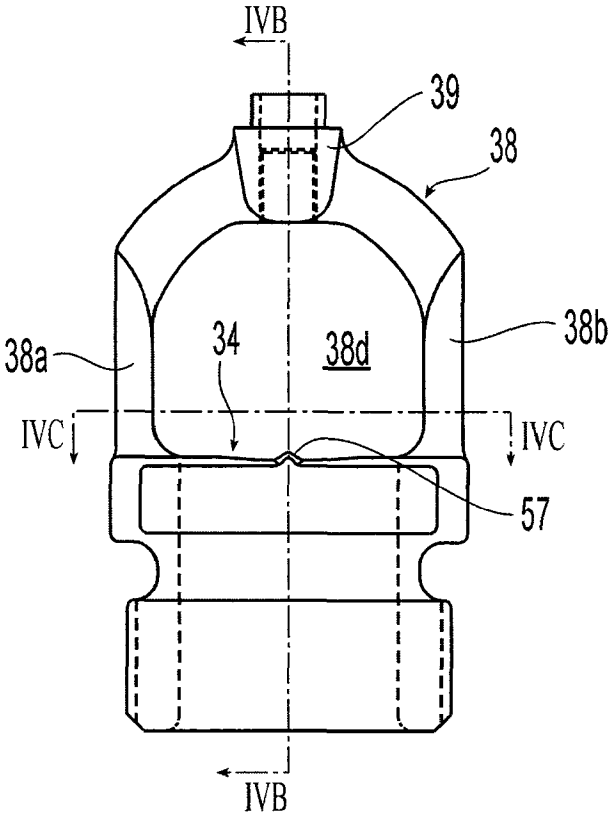
Figure 4C:
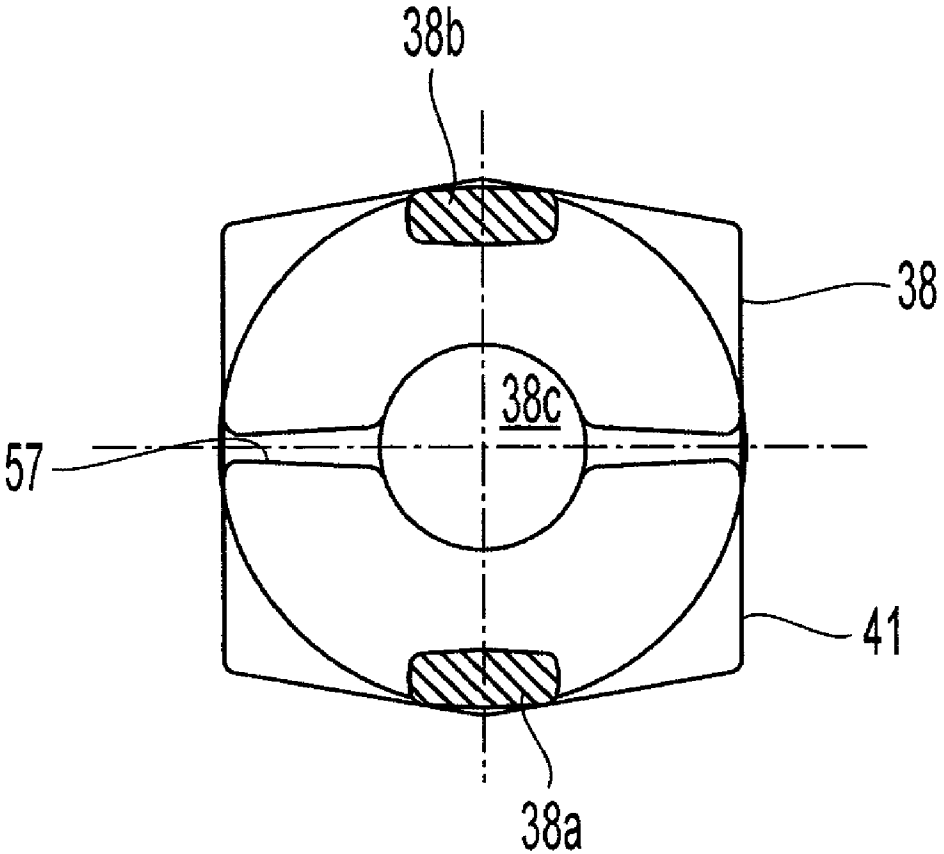

Further referring to FIGS. 3A, 4A and 4B, the sprinkler frame 38 includes a pair of frame arms 38*a*, 38*b* diametrically disposed about the frame axis B-B. The frame arms 38*a*, 38*b* extend distally of the outlet 34 and preferably converge about the sprinkler axis A-A to define a boss 39 to engage and distally locate the deflector 18 relative to the remainder of the sprinkler 10. More preferably, the frame arms 38*a*, 38*b* extend linearly in the distal direction from the distal surface of the frame 38 and then converge so that each arm defines a radius of curvature. The frame arms 38*a*, 38*b* further define a sprinkler window 38*d* through which water passes to wet the area below the installed sprinkler 10 and further wet the backwall 17. The sprinkler frame 38 includes an interior surface defining a passageway 38*c* between the inlet of the frame 38 and the outlet 34. The passageway 38*c* is dimensioned to receive a tubular element which defines at least in-part the preferred K-Factor of 10.2 GPM$(PSI)^{1/2}$- 11.2 GPM/$(PSI)^{1/2}$ and more preferably 11.2 GPM$(PSI)^{1/2}$. Shown in the plan view of FIG. 4C, is a plan view of the sprinkler frame 38. At least a portion of the peripheral surface of the sprinkler 38 defining a polygonal geometry 41 for engagement with an installation tool.

Referring again to FIG. 3A, disposed within the passageway 36 of sprinkler 10 is a sealing assembly 42 aligned along the axis A-A for controlling the unactuated and the actuated states of the sprinkler 10. The sealing assembly 42 includes a plug assembly for sealing the inlet 32 of the sprinkler in the unactuated state. The plug assembly includes plug 44*b* having a gasketed spring seal 44*a* disposed about the plug 44*b*. The plug 44*b* is pivotally connected to a yoke 46 which is configured to axially slide within the casing to displace the plug assembly from inlet 32 to permit fluid to enter the passageway 36. The yoke 46 is biased axially in the distal direction by a spring element 48 disposed within the inlet member 40.

Resisting the spring bias so as to locate the yoke 46 and the plug assembly in the sealed position within the inlet 32, the sealing assembly 42 further preferably includes an elongate water or other fire fighting liquid tube 50 disposed within the passageway of the casing 30 and having an interior passageway in fluid communication with the passageway 36 of the casing and a proximal end engaged with and in axial support of the yoke 46. Disposed within the distal end of the water tube 50 is an insert member 52. The insert member 52 defines an outer shoulder for engaging the distal edge of the water tube 50 to limit the axial travel of the insert in the proximal direction of the water tube 50. The insert member 52 further defines an interior shoulder for engagement with the proximal end of a guide tube 54. The guide tube 54 extends distally along the passageway 36 and terminates within the passageway of the sprinkler frame 38 to engage a bulb seat 56.

The bulb seat 56 is disposed within the outlet 34. Shown more specifically in FIG. 3B, the distal surface of the bulb seat 56 includes an axially aligned receptacle for receipt of a thermally sensitive device to thermally trigger actuation and operation of the sprinkler 10. Preferably the thermally sensitive device is a glass bulb 58 preferably rated to one of 155° F. and 200° F. The bulb 58 is compressively secured to the seat 56 by a compression screw 60 threadedly disposed within a central bore formed in the boss 39. The bulb 60 resists the spring bias of the spring member 46 to secure the plug assembly 44*a*, 44*b* within the inlet 32 of the proximal end 12 of the sprinkler 10 and further secure the bulb seat 56 within the outlet 34 of the distal end 14 of the sprinkler 10. The use of the thermally responsive bulb 58 provides for a preferred configuration of actuating the sprinkler 10 by eliminating the need for an ejector spring or other mechanical linkage to open the outlet 34.

In operation of the sprinkler 10 installed in a manner as described above, a fire heats the liquid in the bulb 58 so as to shatter the bulb 58 and actuate the sprinkler 10. With the bulb 58 displaced, the spring member biases and displaces the yoke 46, water tube 30, insert member 52 and guide tube 54 in the distal direction so as to axially displace the plug assembly 44*a*, 44*b* from the inlet 32 and the bulb seat 56 from the outlet 34. With the plug assembly 44*a*, 44*b* displaced from the inlet, liquid enters the passageway 36 to fill the casing 30 and the water tube 50 to engage the proximal surface of the bulb seat 50. Water or other fire fighting liquid engaging the proximal surface of the bulb seat 56 pushes the bulb seat from the distal end of the guide tube 54 for water or other liquid discharge from the outlet 34.

Figure 5B:
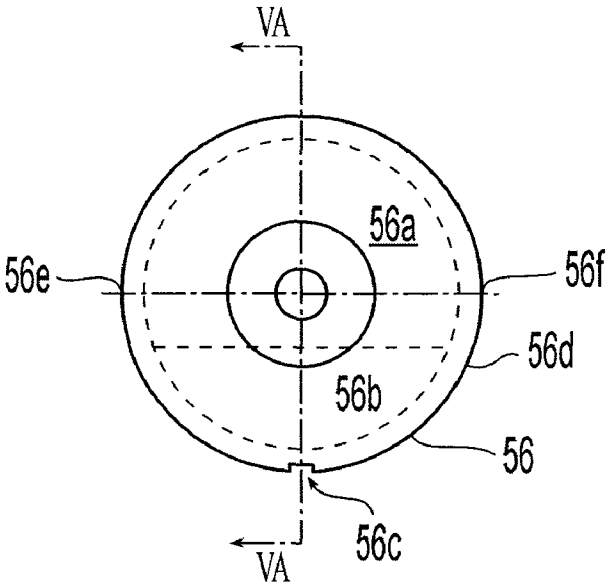
FIGS. 5A-5B is a cross-sectional and plan view of a bulb seat for use in the sprinkler of FIG. 1.
Figure 5A:
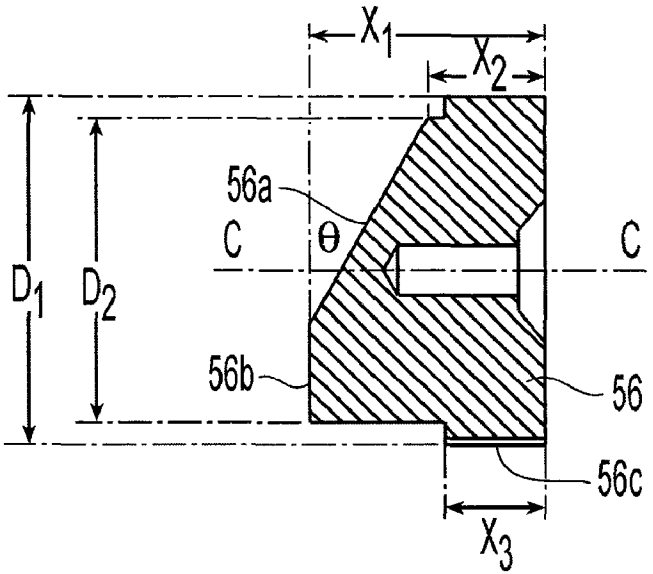

Referring to FIGS. 5A and 5B, shown are a cross-section and plan view of the bulb seat 56 which is preferably machined from brass. The bulb seat 56 preferably defines a total axial length $X_1$ of about 0.5 inches and more preferably 0.52 inches. The bulb seat 56 further preferably includes a proximal portion for insertion in the passageway of the sprinkler frame 38 and a broader distal portion to define a shoulder for engagement with a distal surface of the sprinkler frame 38. A step transition is preferably formed between the broader distal portion and the narrower proximal portion. The bulb seat 56 preferably defines a maximum peripheral diameter $D_1$ of about 0.8 inches in the broader distal portion, and a maximum peripheral diameter $D_2$ of about 0.7 inches in the proximal portion at the point of the step transition. The proximal portion further preferably includes an angled surface 56*a* that initiates from its periphery and extends obliquely toward the bulb seat axis C-C. The angled surface 56*a* preferably initiates along the periphery at a distance of $X_2$ about 0.26 inches from the distal end surface of the bulb seat 56, and the broader distal portion extends proximally from the distal end surface for a preferred distance $X_3$ of about 0.23 inches. Accordingly, the angled surface 56*a* preferably initiates at about the midpoint of the total axial length $X_1$ of the bulb seat. The angled surface 56*a* continues to the proximal end surface 56*b* of the bulb seat 56 so as to preferably define an angle θ of about twenty-nine degrees (29°) relative to a line transverse to the axis C-C. More preferably, angled surface 56*a* crosses the seat axis C-C. At the point where the angled surface 56*a* terminates at the proximal end, the proximal end surface 56*b* radially extends to the periphery of the proximal portion of the seat 56 transverse to the axis C-C. Accordingly, the proximal portion of the bulb seat 56 tapers transverse to its axis such that the bulb seat 56 has more mass to one side of the seat axis C-C than the other side of the axis such that the center of mass of the bulb seat 56 is radially offset from the seat axis C-C.

In addition to defining the impact location with the frame arms 38*a*, 38*b*, the diameter $D_1$ of the distal surface of the bulb seat further preferably defines the dimensions of the various surfaces 56*a*, 56*b*, 56*c*, $D_2$ of the bulb seat 56. In view of the dimensions provided above, the diameters of the proximal and distal portions define a ratio $D_2$:$D_1$ of about 0.88:1. The ratio of the overall seat length to maximum diameter $X_1$:$D_1$ is preferably about 0.63:1. The ratio of the angled surface initiating distance to maximum diameter $X_2$:$D_1$ is preferably about 0.33:1, and the ratio of the distal portion axial length to maximum diameter $X_3$:$D_1$ is preferably about 0.29:1.

When the bulb seat 56 is installed at the distal end of the insert tube 54 within the sprinkler 10, a preferred water passageway geometry 36 is defined. Specifically, the angled surface 56*a* allows water/liquid that has entered passageway 36 to engage the proximal surface 56*a*, 56*b* of the bulb seat in an uneven manner. The uneven engagement of the water against the bulb seat 56 facilitates removal or ejection of the bulb seat 56 from the distal end of the insert tube to clear the passageway for the flowing water to impact the deflector 18. The impact of the water discharge further drives the bulb seat 56 into the frame arms 38*a*, 38*b* so as to impact the frame arms at two points 38*e*, 38*f* with two points 56*e*, 56*f* along the bulb seat peripheral edge 56*d* formed by the intersection of the distal and peripheral surface of the distal portion. The distal and peripheral surfaces of the distal portion of the bulb seat 56 preferably intersect one another perpendicularly so as to define a substantially linear edge 56*d*. Alternatively, the edge 56*d* may be defined by a chamfered surface between the distal and peripheral surfaces of the distal portion of the bulb seat 56. Preferably, the distal portion of the bulb seat 56 and the sprinkler frame window 38*d* are dimensioned such that the point of contact 38*e*, 38*f* is intermediate the outlet 34 and the boss 39. The two points of engagement of the peripheral edge 56*e*, 56*f* and the frame arms 38*e*, 38*f* together define a pivot axis D-D about which the bulb seat 56 can pivot out of the frame window 38*d*. The two contact points 56*e*, 56*f* of the bulb seat 56 can be diametrically opposed as seen for example, in FIG. 3A or they may define a shorter chord length therebetween provided they are sufficiently far apart to intersect the frame arms 38*a*, 38*b* intermediate the outlet 34 and the boss 39 and form the pivot axis D-D. Given the preferred design of the bulb seat 56 described above, the center of mass of the bulb seat 56 is offset from the plane defined by the pivot axis D-D and the sprinkler axis A-A such that the impact of the water discharge on the proximal surfaces 56*a*, 56*b* of the bulb seat rotate the bulb seat about the axis D-D out of the sprinkler frame window 38*d*. Accordingly, the configuration of the bulb seat 56 in combination with the frame arms 38*a*, 38*b* utilizes the discharging water or other fluid to clear the sprinkler frame window 38*d* and thus eliminates the need for a spring or other mechanical linkage to clear the bulb seat from the window 38*d* and discharge path.

Figure 3B:
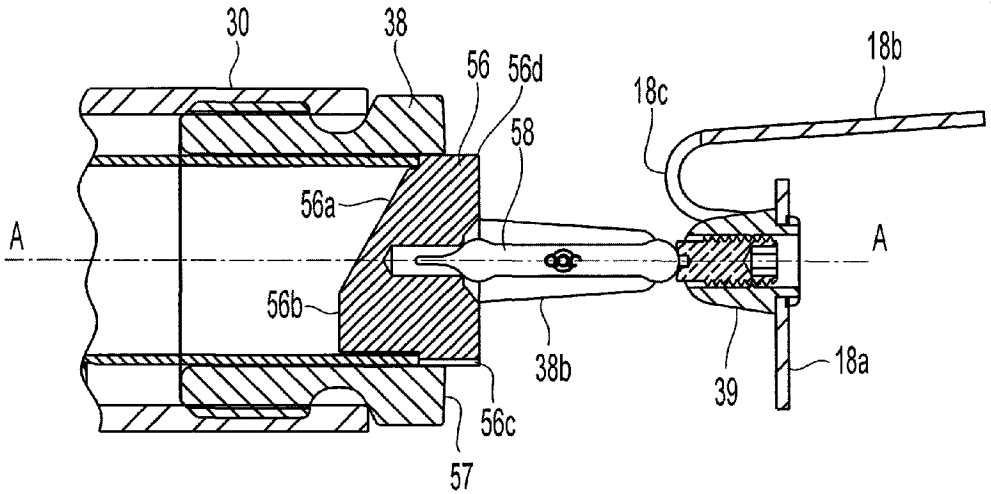
FIG. 3B is a detailed cross-sectional view of the sprinkler of FIG. 3A along line IIIB-IIIB.

With the sprinkler 10 installed in its horizontal sidewall configuration, as seen for example in FIG. 3B, the bulb seat 56 is preferably installed and oriented so that the angled surface 56*a* is substantially located above the sprinkler axis A-A. Moreover, the angled surface 56*a* is preferably oriented such that the centerline VA-VA bisecting the surface 56 is centrally disposed between the frame arms 38*a*, 38*b*. To facilitate the proper orientation of the bulb seat 56 and its angled surface 56*a*, the distal portion of the bulb seat 56 preferably includes an axially extending notch or groove 56*c*, shown for example in FIGS. 5A and 5B along the peripheral surface of the distal portion, preferably along the axial length $X_3$ of the distal portion, and further preferably axially aligned with the centerline VA-VA of the angled surface 56*a*. Moreover, the groove 56*b* is preferably located along the portion of the periphery of the bulb seat 56*b* diametrically opposed to where the angled surface 56*a* peripherally initiates. The bulb seat 56 is properly oriented in the sprinkler frame 38 by aligning the groove 56*b* with a reference point on the sprinkler frame 38.

Shown in FIG. 4C is a plan view of the sprinkler frame 38. The reference point is preferably configured as an elongated ridge 57 located along the distal surface of the frame 38 that defines the discharge opening of the sprinkler frame passageway 38*c*. The ridge 57 runs perpendicular to and bisects the plane or window 38*d* that is defined by the frame arms 38*a*, 38*b*. In the installation of the bulb seat 56 in the frame 38, the groove 56*b* of the seat 56 is aligned within seven degrees of the ridge 57. Moreover, the groove 56*b* is preferably located to the one side of the plane defined by the frame arms 38*a*, 38*b* opposite the top of the deflector 18 so as to dispose a substantial portion of the angled surface 56*a* above the sprinkler axis A-A and a substantial mass of the bulb seat 56 below the sprinkler axis A-A as shown, for example, in FIG. 3B.

Figure 6A:
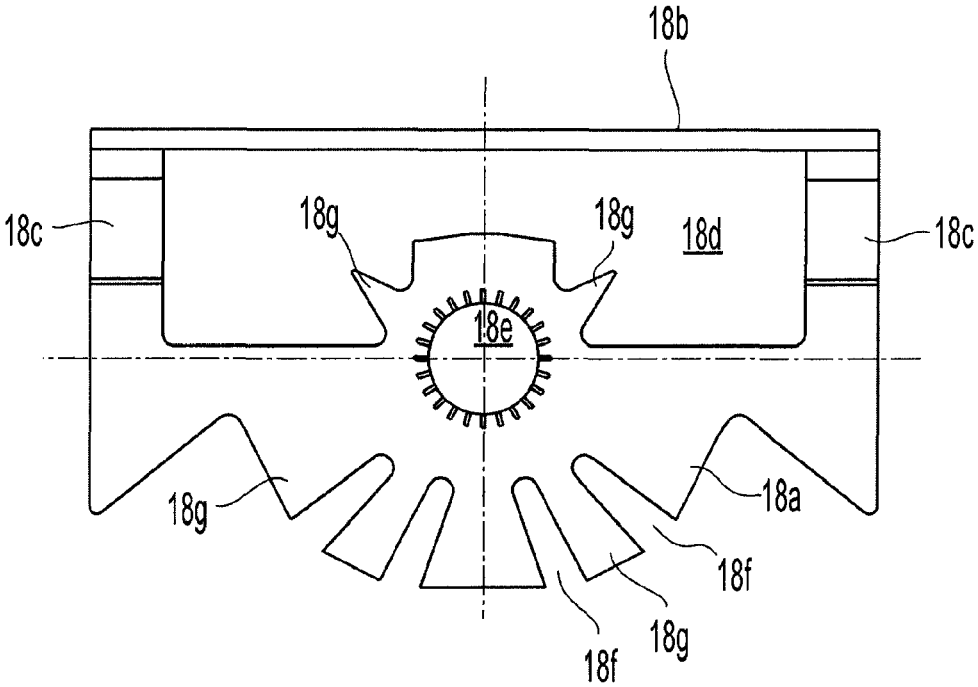
FIGS. 6A-6C are elevation, side and plan views of a deflector for use in the sprinkler of FIG. 1.
Figure 6B:
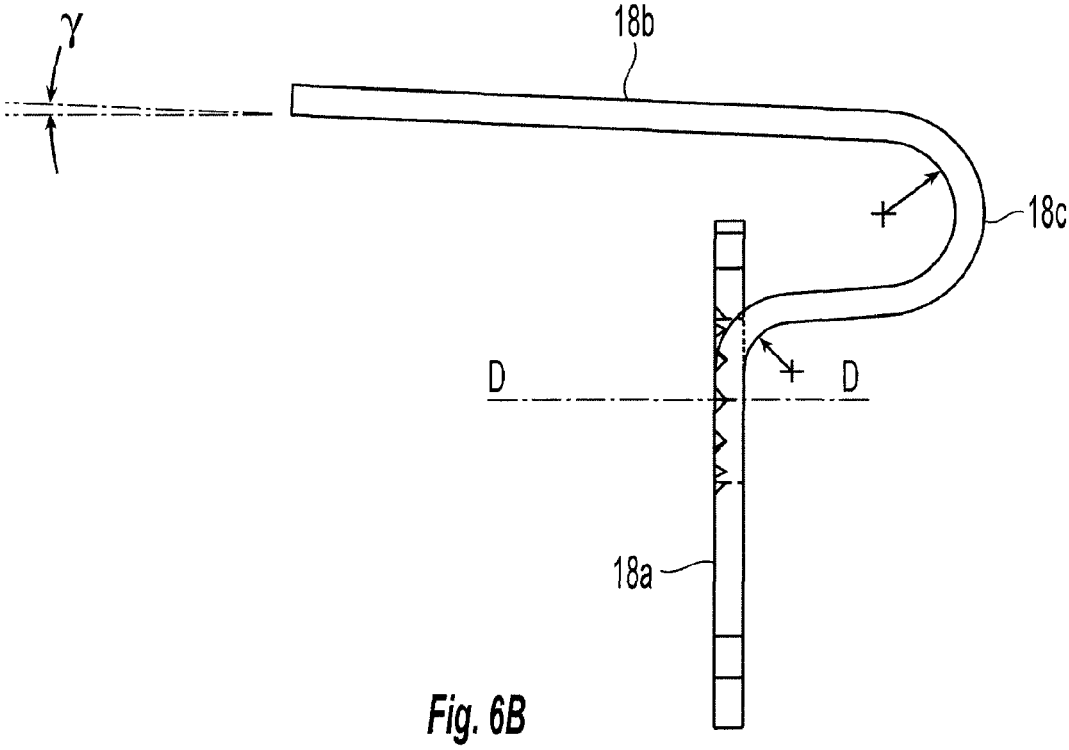
Figure 6C:
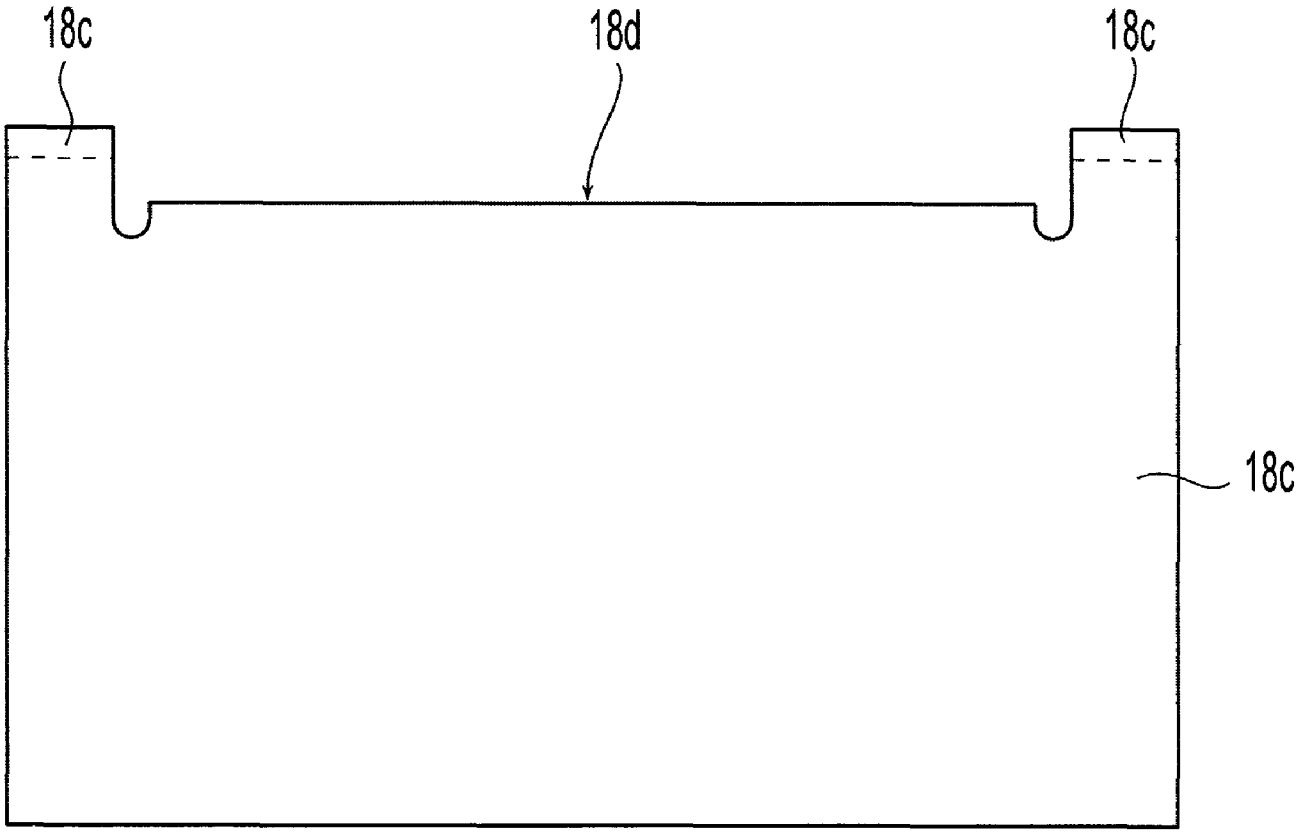
Figure 7A:
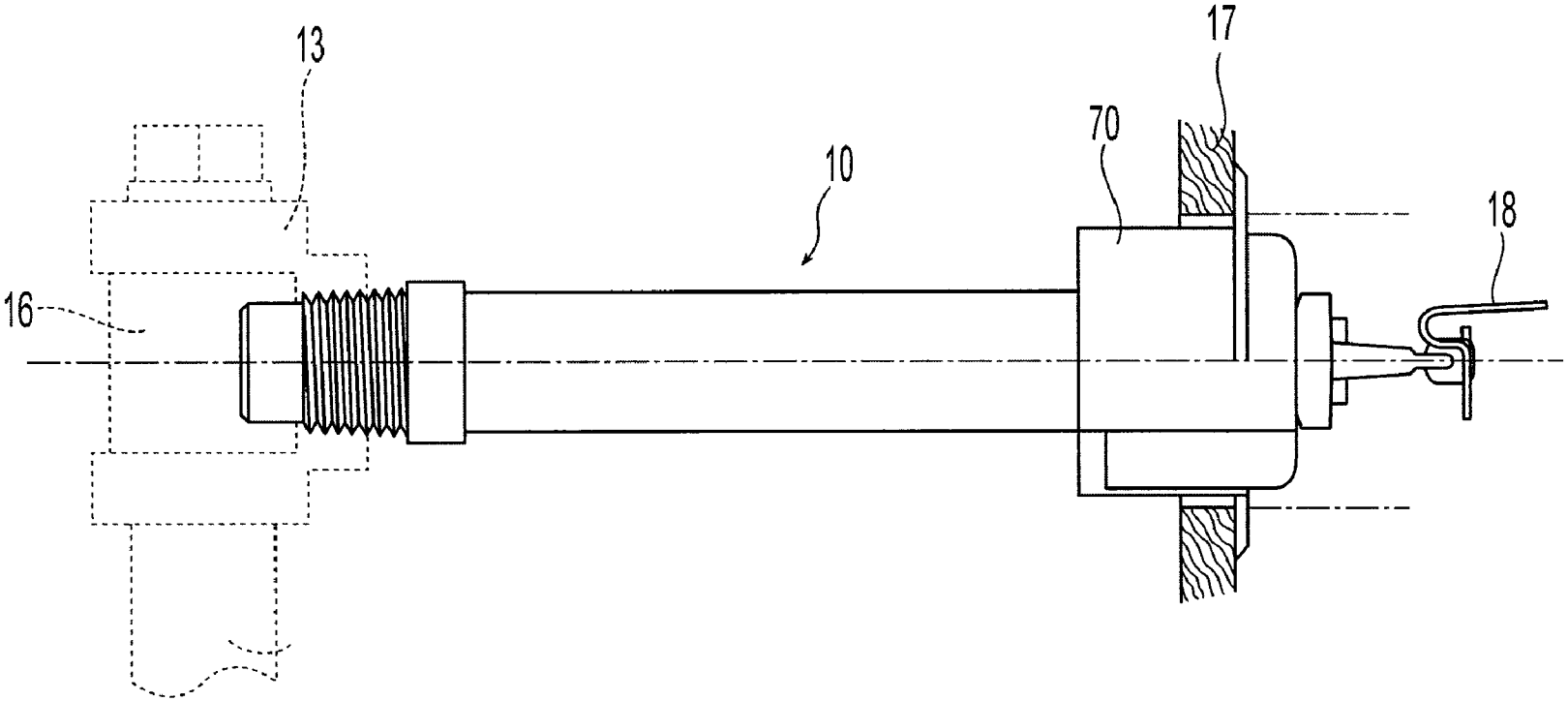
FIGS. 7A-7B are alternate installations of the sprinkler of FIG. 1.
Figure 7B:
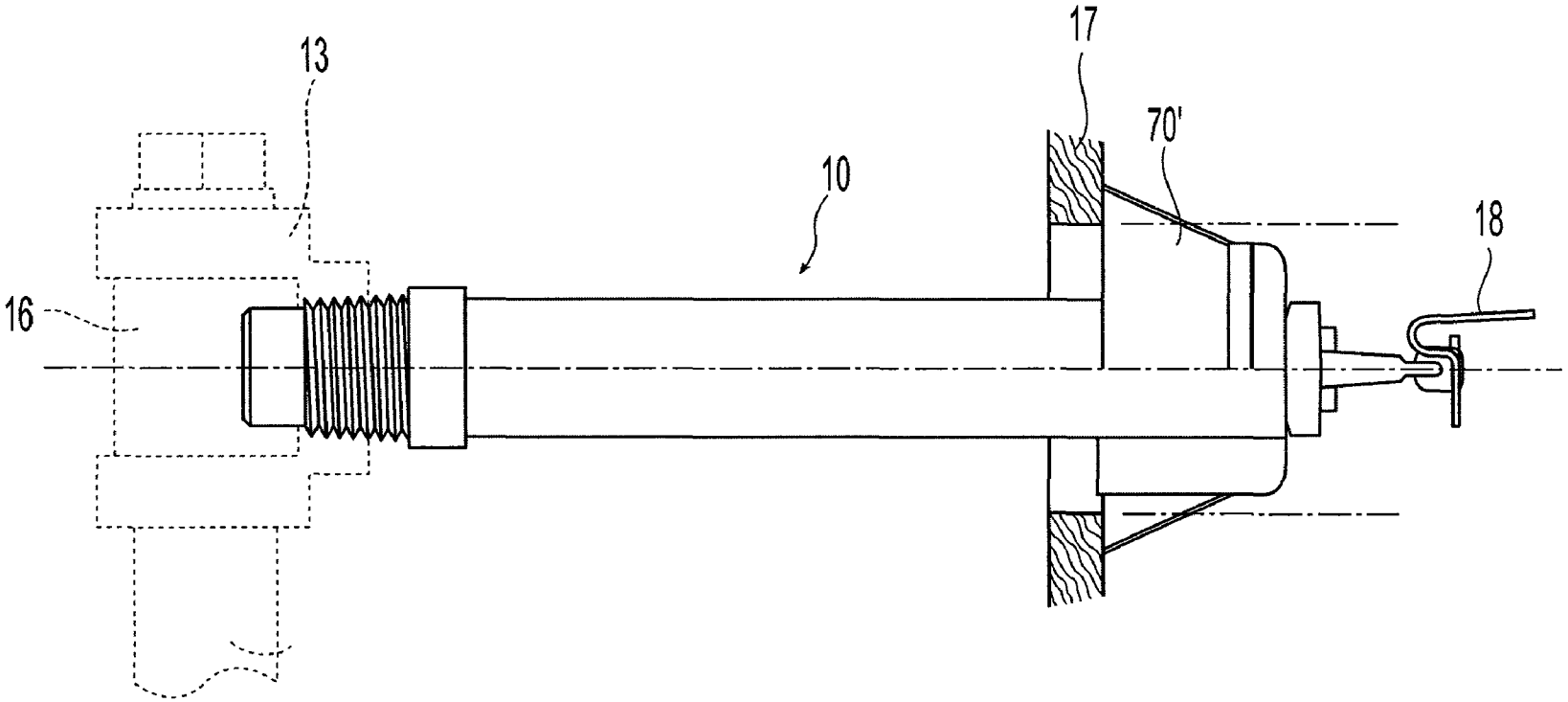

The deflector 18 of the preferred sprinkler 10, as seen in FIG. 3B, preferably includes a face portion 18*a*, a canopy portion 18*b* and a pair of arms 18*c* supporting the canopy portion 18*b* off the canopy face portion 18*a*. Shown in FIGS. 6A-6C is the deflector 18 in greater detail. The deflector 18 is preferably cut from a single blank of sheet metal and bent to form. Accordingly, the face portion 18*a*, canopy portion 18*b* and arms 18*c* together define a deflector window 18*d* through which water can pass. The deflector face portion 18*a* preferably includes a centralized bore 18*e* for engagement about the boss 39 of the sprinkler frame 38. Accordingly, when mounted to the sprinkler frame 38, the face portion 18*a* of the sprinkler frame 38 is substantially perpendicular to the sprinkler axis A-A. Radially disposed about the central bore 18*e* are a plurality of slots 18*f* defining tines 18*g* therebetween along the bottom portion of the face 118*a*. Additional tines 18*g* can be formed along the top of the face portion 18*a*. The slots 18*f* preferably vary in width along their direction of formation. The deflector arms 18*c* are preferably located at the lateral ends of the deflector 18. The arms 18*c* are preferably arcuate to locate the canopy portion 18*b* spaced from and above the face portion 18*a*. Accordingly, the canopy portion 18*b* forms the top of the deflector 18 disposed above the sprinkler axis A-A in each of the horizontal installations shown in FIGS. 1, 7A and 7B. Where FIG. 1 shows a dry sprinkler installation without an escutcheon, FIG. 7A shows a dry sprinkler with a flush escutcheon 70, and FIG. 7B shows a dry sprinkler with a deep escutcheon 70'. Preferably, the canopy portion 18*b* is a planar member, as seen for example in FIGS. 6B and 6C, defining an angle γ of about three degrees and more preferably 2.5 degrees (2.5°) relative to a line parallel to the deflector axis D-D or no more than eighty-eight degrees (88°) relative to a plane perpendicular to the deflector axis D-D.

As noted above, the preferred K-factor of 10.2-11.2 GPM/(PSI)$^{1/2}$ of the sprinkler 10 is partially defined by the sprinkler frame passageway and outlet. The preferred sprinkler is further preferably defined by the length of the casing 30 and the internal sealing assembly 40. More specifically, a K-factor length is preferably defined by a function of the length $L_1$ between mounting surface 17 and the face of the fitting 13 in the supply pipe 16. Shown in Table 2 below is the relation between the mounting surface-to-fitting $L_1$, the preferred mounting configuration, a K-Factor Length determination, and the preferred K-factors.

TABLE 2

| Mounting Configuration & K-Factor Length Determination | K-Factor Length (inches) | K-Factor (GPM/(PSI)$^{1/2}$) |
|---|---|---|
| w/o Escutcheon<br>$L_1$ − 2 in.<br>Flush Escutcheon<br>$L_1$ + ½ in.<br>Deep Escutcheon<br>$L_1$ + 3.25 in. | 2.5-14.75 | 11.2 |
| w/o Escutcheon<br>$L_1$ − 2 in.<br>Flush Escutcheon<br>$L_1$ + ½ in.<br>Deep Escutcheon<br>$L_1$ + 3.25 in. | 15-18.75 | 10.9 |
| w/o Escutcheon<br>$L_1$ − 2 in.<br>Flush Escutcheon<br>$L_1$ + ½ in.<br>Deep Escutcheon<br>$L_1$ + 3.25 in. | 19-23 | 10.8 |
| w/o Escutcheon<br>$L_1$ − 2 in.<br>Flush Escutcheon<br>$L_1$ + ½ in.<br>Deep Escutcheon<br>$L_1$ + 3.25 in. | 23.25-26.75 | 10.7 |
| w/o Escutcheon<br>$L_1$ − 2 in.<br>Flush Escutcheon<br>$L_1$ + ½ in.<br>Deep Escutcheon<br>$L_1$ + 3.25 in. | 27.25-31.25 | 10.6 |

TABLE 2-continued

| Mounting Configuration & K-Factor Length Determination | K-Factor Length (inches) | K-Factor (GPM/(PSI)$^{1/2}$) |
|---|---|---|
| w/o Escutcheon<br>$L_1$ − 2 in.<br>Flush Escutcheon<br>$L_1$ + ½ in.<br>Deep Escutcheon<br>$L_1$ + 3.25 in. | 31.5-35.25 | 10.5 |
| w/o Escutcheon<br>$L_1$ − 2 in.<br>Flush Escutcheon<br>$L_1$ + ½ in.<br>Deep Escutcheon<br>$L_1$ + 3.25 in. | 35.5-39.5 | 10.4 |
| w/o Escutcheon<br>$L_1$ − 2 in.<br>Flush Escutcheon<br>$L_1$ + ½ in.<br>Deep Escutcheon<br>$L_1$ + 3.25 in. | 39.75-43.5 | 10.3 |
| w/o Escutcheon<br>$L_1$ − 2 in.<br>Flush Escutcheon<br>$L_1$ + ½ in.<br>Deep Escutcheon<br>$L_1$ + 3.25 in. | 43.75-48 | 10.2 |

While the present invention has been disclosed with reference to certain preferred embodiments, numerous modifications, alterations, and changes to the described embodiments are possible without departing from the sphere and scope of the present invention, as described herein. Accordingly, it is intended that the present invention not be limited to the described embodiments, but that it have the full scope defined by the language of the following claims, and equivalents thereof.

What We claim is:

1. A dry sidewall horizontal sprinkler having an actuated and an unactuated state, the sprinkler comprising:

a tube having a proximal end and a distal end, the proximal end of the tube having an inlet for connection to a liquid supply system containing a liquid, the tube defining a dry passageway extending therethrough and disposed along a longitudinal sprinkler axis, the tube providing fluid communication of the liquid between the proximal end and the distal end when the sprinkler is in the actuated state;

a sprinkler body engaging the distal end of the tube, the body including a frame and a pair of frame arms extending distal of the frame, the frame defining an outlet in fluid communication with the dry passageway for discharge of the liquid when the sprinkler is in an actuated state, the pair of frame arms disposed on a bisectional plane that includes the longitudinal sprinkler axis, each of the pair of frame arms having a proximal facing impact point disposed on the bisectional plane;

a deflector engaging the frame arms and distally spaced from the outlet for distribution of the liquid when the liquid is discharged from the outlet in the actuated state, the deflector including a canopy portion radially spaced from the longitudinal sprinkler axis, the deflector providing an extended coverage protection area at a density of 0.15 GPM per square foot to 0.20 GPM per square foot for an ordinary hazard occupancy; and a sealing assembly disposed within the dry passageway to control liquid flow of the liquid from the liquid supply system to the dry passageway, the sealing assembly including a spring seal disposed against a distal side of the tube inlet to seal the inlet in the unactuated state, the sealing assembly including a seat member disposed in the outlet to align a pair of distal facing impact points on opposing sides of the seat member on the bisectional plane, the seat member distal facing impact points and the frame arm proximal facing impact points disposed at the same radial distance from the longitudinal sprinkler axis, a substantial portion of a mass of the seat member being disposed to a lower side of the bisectional plane, the seat member having a proximal planar surface disposed on a plane that is normal to the longitudinal sprinkler axis and a proximal oblique surface that intersects the longitudinal sprinkler axis at an acute angle to define an oblique portion of the seat member, the oblique portion of the seat member disposed substantially to an upper side of the bisection plane and directly adjacent to the proximal planar surface.

2. The sprinkler of claim 1, wherein the protection area ranges from about 256 square feet to about 320 square feet.

3. The sprinkler of claim 1, wherein the tube and sprinkler body define a K-factor of greater than 5.8 GPM/$(PSI)^{1/2}$.

4. The sprinkler of claim 3, wherein the tube and sprinkler body define a K-factor of about 8 GPM/$(PSI)^{1/2}$.

5. The sprinkler of claim 3, wherein the tube and sprinkler body define a K-factor ranging from about 10.2 GPM/$(PSI)^{1/2}$ to about 11.2 GPM/$(PSI)^{1/2}$.

6. The sprinkler of claim 5, wherein the tube and sprinkler body define a K-factor is about 11.2 GPM/$(PSI)^{1/2}$.

7. The sprinkler of claim 1, wherein the proximal facing impact points defining a pivot axis extending through the proximal facing impact points.

8. The sprinkler of claim 1, wherein, when in the unactuated state, the seat member is prevented from rotating about an axis passing through the distal facing impact points of the seat member and, when in the actuated state, the seat member is disposed to rotate about the axis passing through the distal facing impact points of the seat member.

9. A dry sidewall sprinkler for protection of extended coverage ordinary hazard occupancies, the sprinkler having an actuated and an unactuated state, and the sprinkler comprising:

a tubular casing having a proximal end and a distal end, the proximal end of the casing being configured for connection to a wet system having a liquid supply, the casing defining an interior dry passageway along a longitudinal axis when the sprinkler is unactuated, the passageway further providing for communication of the liquid between the proximal and the distal end when the sprinkler is actuated;

a sprinkler body coupled to the distal end of the casing and including a frame and a pair of frame arms extending distal of the frame, the frame defining an outlet in communication with the passageway for discharge of the liquid;

a deflector disposed distal of the sprinkler body and coupled to the frame arms for distribution of the liquid discharged from the outlet; and a sealing assembly disposed within the passageway to control liquid flow from the supply to the passageway, the sealing assembly including a seat member disposed in the outlet having a proximal surface disposed within the passageway for engaging the liquid when the sprinkler is actuated, the proximal surface defining at least a portion oblique to the longitudinal axis and a portion transverse to the longitudinal axis; the portion oblique to the longitudinal axis being directly adjacent to the portion transverse to the longitudinal axis.

10. The sprinkler of claim 9, wherein the deflector includes a face portion disposed in a first plane perpendicular to the longitudinal axis and a canopy portion disposed at an angle to the first plane.

11. The sprinkler of claim 10, wherein the canopy portion defines an included angle with the first plane that is no greater than about 88 degrees.

12. The sprinkler of claim 10, wherein the canopy portion is disposed to a first side of a second plane including the longitudinal axis, bisecting the tube and substantially perpendicular to the face portion.

13. The sprinkler of claim 11, wherein the oblique portion of the proximal surface of the seat member is disposed substantially to the first side of the second plane.

14. The sprinkler of claim 12, wherein a substantial portion of the mass of the seat member is disposed to a second side of the second plane opposite the first side.

15. The sprinkler of claim 9, wherein the sealing assembly further comprises a tube disposed within and in fluid communication with the passageway of the tubular casing.

16. The sprinkler of claim 15, wherein the seat assembly further comprises an insert member disposed within an interior passageway of the sprinkler frame and having a proximal end coupled to the tube and a distal end engaged with the seat member.

17. The sprinkler of claim 9, wherein the sprinkler further comprises an inlet frame disposed about the proximal end of the casing, the inlet frame defining an inlet opening in communication with the passageway.

18. The sprinkler of claim 16, wherein the sealing assembly includes a yoke engaged with the proximal end of the tube, the yoke having a plug member for engagement with the inlet opening to control liquid flow from the liquid supply to the water tube, the yoke being biased in the distal direction.

19. The sprinkler of claim 18, wherein the sealing assembly further includes a thermally sensitive device to define the unactuated and actuated states of the sprinkler, the device being seated against the seat member in the unactuated state to support the sealing assembly in the proximal direction such that the plug member is disposed within the inlet to maintain the passageway dry.

20. The sprinkler of claim 9, wherein the frame arms form a window and the seat member includes a distal portion defining a first diameter and a proximal portion including the proximal surface defining a second diameter larger than the first, the distal portion having a central axis and a distal surface for seating a thermally sensitive device along the central axis to define the actuated and the unactuated states, the distal surface defining a peripheral edge for engagement with the frame arms when the sprinkler is actuated such that the seat member is disposed within the window.

21. The sprinkler of claim 20, wherein two points along the peripheral edge engage the frame arm to define an axis of rotation about which the seat member rotates when the sprinkler is actuated.

22. The sprinkler of claim 21, wherein the two points are substantially diametrically opposed.

23. The sprinkler of claim 9, wherein the frame arms form a window and the seat member defines an axial length and includes a distal portion defining a first diameter and a proximal portion including the proximal surface defining a second diameter larger than the first, the distal portion having a central axis and a distal surface for seating a thermally sensitive device along the central axis to define the actuated and the unactuated states, the oblique portion initiating along a periphery of the proximal portion about one-half the axial length from the distal surface.

24. The sprinkler of claim 23, wherein the oblique surface extends from the periphery of the transverse portion of the proximal surface, the oblique surface crossing the central axis.

25. The sprinkler of claim 24, wherein the oblique portion defines an included angle of about twenty-nine degrees)(29°) with a line transverse to the longitudinal axis.

26. The sprinkler of claim 23, wherein the center of mass of the seat member is offset from the central axis.

27. The sprinkler of claim 9, wherein the tubular casing, sprinkler body and the sealing assembly define a K-factor of greater than 5.8 GPM/$(PSI)^{1/2}$.

28. The sprinkler of claim 27, wherein the tubular casing, sprinkler body and the sealing assembly define a K-factor of about 8 GPM/$(PSI)^{1/2}$.

29. The sprinkler of claim 27, wherein the tubular casing, sprinkler body and the sealing assembly define a K-factor ranging from about 10.2 GPM/$(PSI)^{1/2}$ to about 11.2 GPM/$(PSI)^{1/2}$.

30. The sprinkler of claim 29, wherein the tubular casing, sprinkler body and the sealing assembly define a K-factor is about 11.2 GPM/$(PSI)^{1/2}$.

* * * * *